US007816600B2

(12) United States Patent
Chandler

(10) Patent No.: US 7,816,600 B2
(45) Date of Patent: Oct. 19, 2010

(54) USE OF CONSTANT FORCE SPRING IN KEYBOARD ASSEMBLY

(75) Inventor: Van S. Chandler, Georgetown, TX (US)

(73) Assignee: Infinite Response, Inc., Austin, TX (US)

( * ) Notice: Subject to any disclaimer, the term of this patent is extended or adjusted under 35 U.S.C. 154(b) by 0 days.

(21) Appl. No.: 12/550,018

(22) Filed: Aug. 28, 2009

(65) Prior Publication Data

US 2010/0037757 A1 Feb. 18, 2010

Related U.S. Application Data

(62) Division of application No. 11/589,278, filed on Oct. 30, 2006, now Pat. No. 7,678,989.

(60) Provisional application No. 60/854,453, filed on Oct. 26, 2006.

(51) Int. Cl.
*G10C 3/12* (2006.01)

(52) U.S. Cl. ..... 84/745; 84/174; 84/423 R; 84/433; 84/423 A

(58) Field of Classification Search ..... 84/745
See application file for complete search history.

(56) References Cited

U.S. PATENT DOCUMENTS

| | | | | |
|---|---|---|---|---|
| 4,043,244 | A | 8/1977 | Schrecongost et al. | |
| 4,129,057 | A | 12/1978 | Hoshi | |
| 4,278,004 | A * | 7/1981 | Klann | 84/434 |
| 4,286,493 | A | 9/1981 | Hardesty et al. | |
| 4,365,536 | A * | 12/1982 | Koepke et al. | 84/433 |
| 4,418,605 | A | 12/1983 | Tollefsen et al. | |
| 4,667,563 | A | 5/1987 | Wakuda et al. | |
| 4,901,614 | A | 2/1990 | Kumano et al. | |
| 5,062,342 | A | 11/1991 | Nagatsuma | |
| 5,105,867 | A | 4/1992 | Coslett | |
| 5,895,875 | A | 4/1999 | Osuga et al. | |
| 6,147,290 | A | 11/2000 | Uno | |
| 6,267,271 | B1 | 7/2001 | Tsuchida et al. | |
| 6,777,605 | B2 | 8/2004 | Wenjun | |
| 7,550,659 | B2 | 6/2009 | Shimoda | |
| 2003/0177885 | A1 | 9/2003 | Wenjun | |

OTHER PUBLICATIONS

Small Parts, Inc. 'Spring, Constant Force-Stainless Steel Type 301', Jun. 8, 2004, http://web.archive.org/web/20040608192322/http://www.smallparts.com/products/descriptions/cfs.cfm.

Yamaha Advanced Sound Technology, http://music.yamaha.com/products/highlights/keyboardsAST/8.html, pp. 1-3.

* cited by examiner

*Primary Examiner*—Jeffrey Donels
*Assistant Examiner*—Christopher Uhlir
(74) *Attorney, Agent, or Firm*—Gilberto M. Villacorta; Kevin L. McHenry; Foley & Lardner LLP

(57) ABSTRACT

An electronic keyboard that includes a plurality of keys including a first key. The keyboard further includes a key support supporting the first key for movement between a rest position and a depressed position. The keyboard also includes a first key return spring configured to apply a return force to the first key to bias the first key toward the rest position. In the keyboard, the first key return spring is configured such that the return force has a substantially constant magnitude throughout the movement of the first key between the rest position and the depressed position.

14 Claims, 4 Drawing Sheets

USE OF CONSTANT FORCE SPRING IN KEYBOARD ASSEMBLY

CROSS-REFERENCE TO RELATED APPLICATIONS

This application is a divisional of U.S. patent application Ser. No. 11/589,278, filed Oct. 30, 2006, which claims priority to U.S. Provisional Application No. 60/854,453, filed Oct. 26, 2006, the entire disclosures of which are incorporated herein by reference.

BACKGROUND OF THE INVENTION

Electronic keyboards (sometimes referred to as music synthesizers) utilize electro-mechanical devices to output electrical signals as a result of actuation of keys on the keyboard to synthesize audible music that replicates the sound of, for example, a piano. In many electronic keyboards, a user moves the keys with his fingers, and the keys actuate switches which open/close a circuit to indicate to a central processor what note is desired to be synthesized. Typically, a device, such as a helical spring, is used to provide a mechanism to return a given key to its rest position, and to provide sufficient resistance against movement to provide a quasi-artificial feel akin to a traditional piano key.

Helical springs have a spring constant such that the force of the spring working against the movement of the key varies as the key moves. For example, if the helical spring is compressed/extended by ten percent of its total at-rest length as a result of movement of the key downward, the force imparted by the spring on the key may be, for example, a tenth of a pound. However, if that same spring is compressed/extended to a distance of 15 percent of its at-rest length, the outputted force of the spring may be 0.15 pounds. That is, the resistance of the key increases as the user presses the key further downward, thus forcing the user to increase the force that he or she applies on the key as the user presses the key to its fully depressed position. This results in an awkward feel for the user, and also may result in the user applying extra force at the beginning of the movement of the key to compensate for the expected greater force that will be necessary to move the key all the way down towards its fully depressed position. This results in a skilled user not being able to fully exercise his or her musical talents on an electronic keyboard.

SUMMARY OF THE INVENTION

An aspect of the present invention relates to an electronic keyboard, comprising a plurality of keys including a first key, a key support supporting the first key for movement between a rest position and a depressed position, and a first key return spring configured to apply a return force to the first key to bias the first key toward the rest position, wherein the first key return spring is configured such that the return force has a substantially constant magnitude throughout the movement of the first key between the rest position and the depressed position.

Another aspect of the present invention relates to an electronic keyboard as described above and/or below, wherein the first key return spring includes a constant force spring comprising a prestressed, coiled strip of substantially flat spring stock.

Another aspect of the present invention relates to an electronic keyboard as described above and/or below, wherein the constant force spring has an outer coil diameter, wherein a portion of the constant force spring extends outward a distance that is at least approximately one and one half times the outer coil diameter before being mechanically linked to the first key, when the first key is in the rest position.

Another aspect of the present invention relates to an electronic keyboard as described above and/or below, wherein the first key return spring is configured to maintain the magnitude of the return force within a range of 1 ounce to five ounces, as measured at a fixed point on the first key, throughout the movement of the first key between the rest position and the depressed position.

Another aspect of the present invention relates to an electronic keyboard as described above and/or below, wherein the first key return spring is configured to maintain the magnitude of the return force to within a plus or minus 20% deviation, as measured at a fixed point on the first key, throughout the movement of the first key between the rest position and the depressed position.

Another aspect of the present invention relates to an electronic keyboard as described above and/or below, wherein the first key return spring extends between and is mechanically linked to the first key and the key support, and wherein the first key return spring is in tension throughout the movement of the first key between the rest position and the depressed position.

Another aspect of the present invention relates to an electronic keyboard as described above and/or below, wherein the first key has a plurality of connection locations at which the first key return spring can be connected to the first key, wherein each of the plurality of connection locations is located at a different distance from a first pivot point of the first key, and wherein the first key return spring imparts a different rotational moment onto the first key at each of the connection locations.

Another aspect of the present invention relates to an electronic keyboard as described above and/or below, further comprising a second key movable between a rest position and a depressed position, and a second key return spring configured to apply a return force to the second key to bias the second key toward the rest position, wherein the first key return spring is configured to impart a first rotational moment onto the first key, wherein the second key return spring is configured to impart a second rotational moment onto the second key that is greater than the first rotational moment, and wherein the first key return spring and the second key return spring apply substantially the same constant force to the first key and the second key, respectively.

Another aspect of the present invention relates to an electronic keyboard as described above and/or below, wherein the first key return spring and the second key return spring have substantially identical configurations.

An aspect of the present invention relates to an electronic keyboard as described above and/or below, wherein the first key return spring is connected to the first key at a first distance from a first pivot point of the first key, wherein the second key return spring is connected to the second key at a second distance from a second pivot point of the second key, and wherein the second distance is greater than the first distance.

Another aspect of the present invention relates to an electronic keyboard, comprising, a plurality of keys including a first key, a key support supporting the first key for movement between a rest position and a depressed position, and a first key bias device configured to apply a return force to the first key to bias the first key toward the rest position, wherein the first key bias device is configured such that the return force has a substantially constant magnitude throughout the movement of the first key between the rest position and the depressed position, and wherein the return force results from elasticity of at least a portion of the first key bias device.

Another aspect of the present invention relates to an electronic keyboard as described above and/or below, wherein the first key bias device is configured to maintain the magnitude of the return force within a range of 1 to five ounces, as measured at a fixed point on the first key, throughout the movement of the first key between the rest position and the depressed position.

Another aspect of the present invention relates to an electronic keyboard as described above and/or below, wherein the first key bias device is configured to maintain the magnitude of the return force to within a plus or minus 20% deviation, as measured at a fixed point on the first key, throughout the movement of the first key between the rest position and the depressed position.

Another aspect of the present invention relates to an electronic keyboard as described above and/or below, wherein the first key has a plurality of connection locations at which the first key bias device can be connected to the first key, wherein each of the plurality of connection locations is located at a different distance from a first pivot point of the first key, and wherein the first key bias device imparts a different rotational moment onto the first key at each of the connection locations.

DETAILED DESCRIPTION OF PREFERRED EMBODIMENTS

Figure 1:
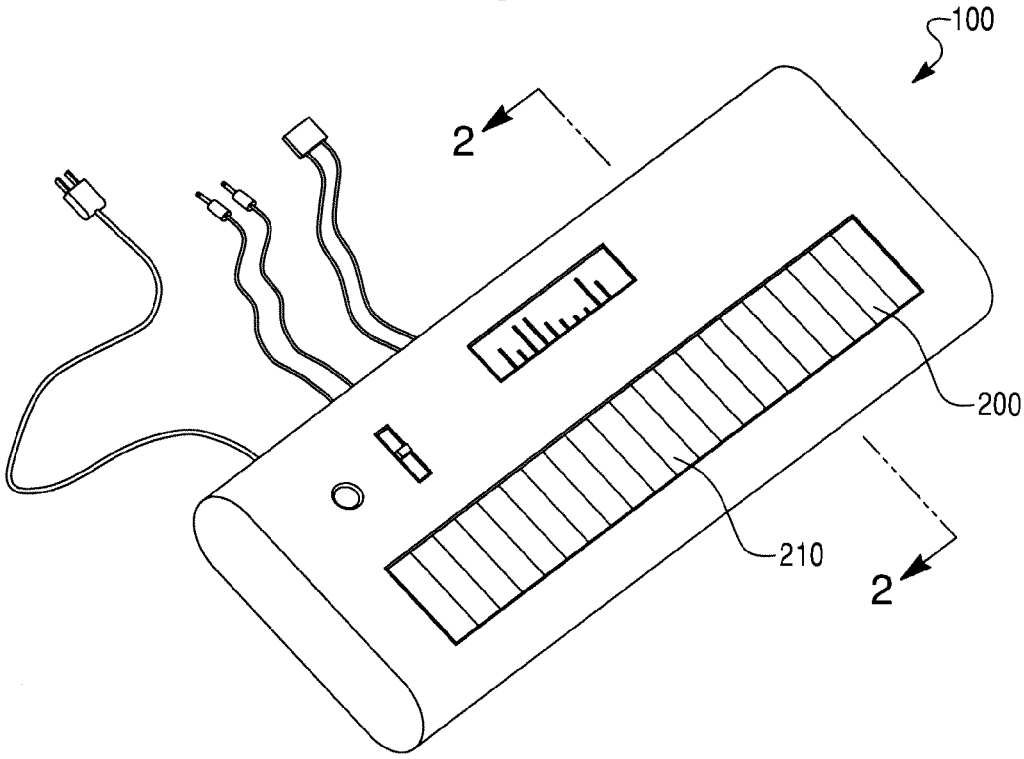
FIG. 1 schematically represents an electronic keyboard according to an embodiment of the present invention.

Presently preferred embodiments of the invention are illustrated in the drawings. An effort has been made to use the same or like reference numbers throughout the drawings to refer to same or like parts.

The inventor has developed a design for an electronic keyboard that applies a return force to a key of the keyboard that has a constant value even as the key is moved from its rest position to its depressed position. The electronic keyboard can be configured such that each of the keys is subjected to a respective constant return force.

FIG. 1 shows an embodiment of an electronic keyboard 100 according to the present invention. The electronic keyboard 100 includes a plurality of keys 200. The plurality of keys include a first key 210, which will be referred to herein for the purposes of describing an exemplary embodiment. The key 210 can be made of any suitable material, including, for example, conventional plastic, and can be shaped and sized in any appropriate configuration.

Figure 2:
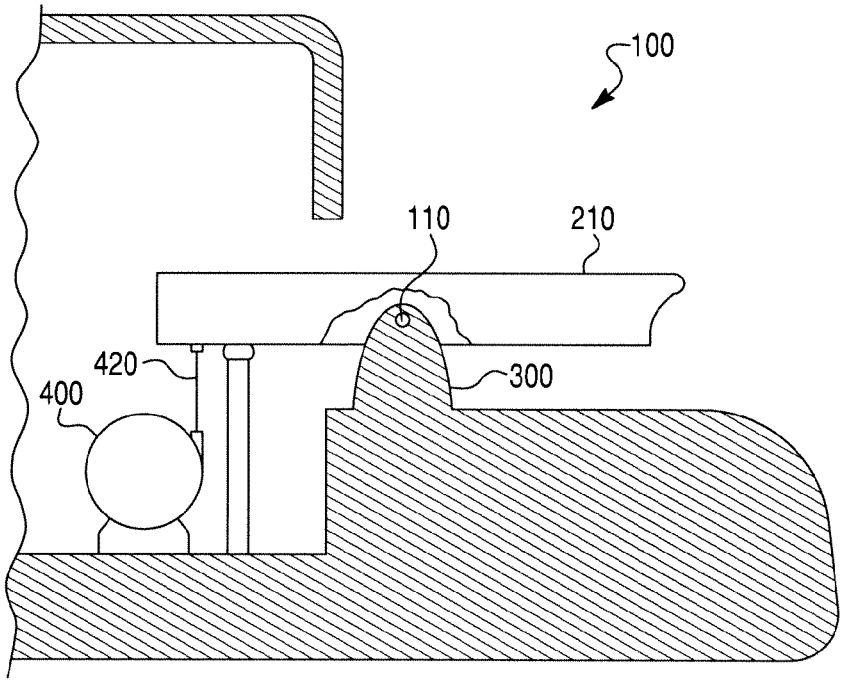
FIG. 2 schematically presents a portion of a cross-sectional view taken through the keyboard of FIG. 1, where the depicted key is at the rest position.

A key support 300 supports the first key 210, as shown in the cross-sectional view of FIG. 2. The key support 300 enables movement of the key 210 between a rest position (depicted in FIG. 2) and a depressed position (depicted in FIG. 3). The key support 300 can be any suitable support that allows proper movement of the first key 210, and preferably permits pivotal movement around a pivot point 110.

A first key bias device 400 is provided to apply a return force to the first key 210. This return force biases the first key towards the rest position. The magnitude of the return force can be measured at a fixed location on the key, such as, for example, one inch from the pivot point at the lateral center of the key, or, say 0.25 inches from the end of the key at the lateral center of the key. The actual force is preferably within a range of one ounce to about five ounces throughout movement of the key between the rest position and the depressed position.

Figure 3:
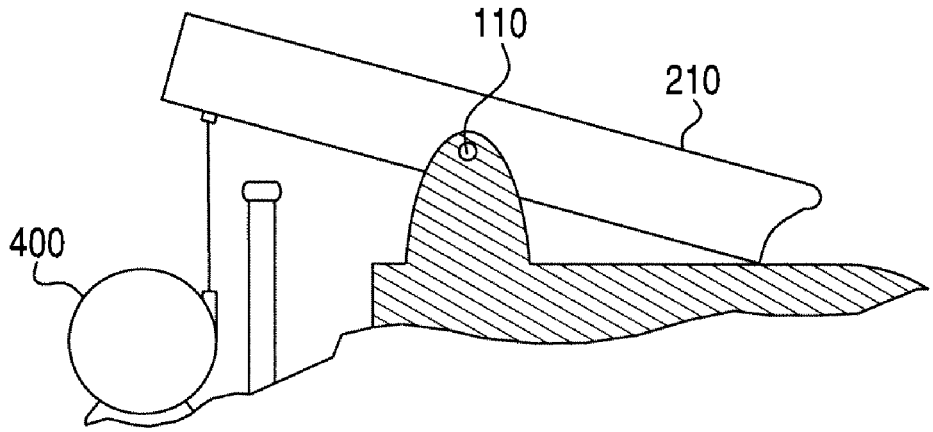
FIG. 3 schematically represents the key, key support, and key return spring of FIG. 2, except that the key is in the depressed position.

The first key bias device 400 is preferably configured such that it applies a return force that has a substantially constant magnitude throughout the movement of the first key 210 between the rest position (depicted in FIG. 2) and the depressed position (depicted in FIG. 3). For example, first key bias device 400 can be configured to maintain the magnitude of the return force to within plus or minus twenty percent deviation throughout movement of the key between the rest position and the depressed position. More preferably, the deviation is only about plus or minus ten percent throughout movement of the first key between the rest position and depressed position. Even more preferably, the deviation is only about plus or minus two percent throughout the movement of the key between the rest position and the depressed position. Even more preferably, the percent deviation is only about plus or minus one percent, or even less, throughout movement of the first key between the rest position and the depressed position. For ease of description, the substantially constant force will often be referred to herein as a constant force.

Figure 8:
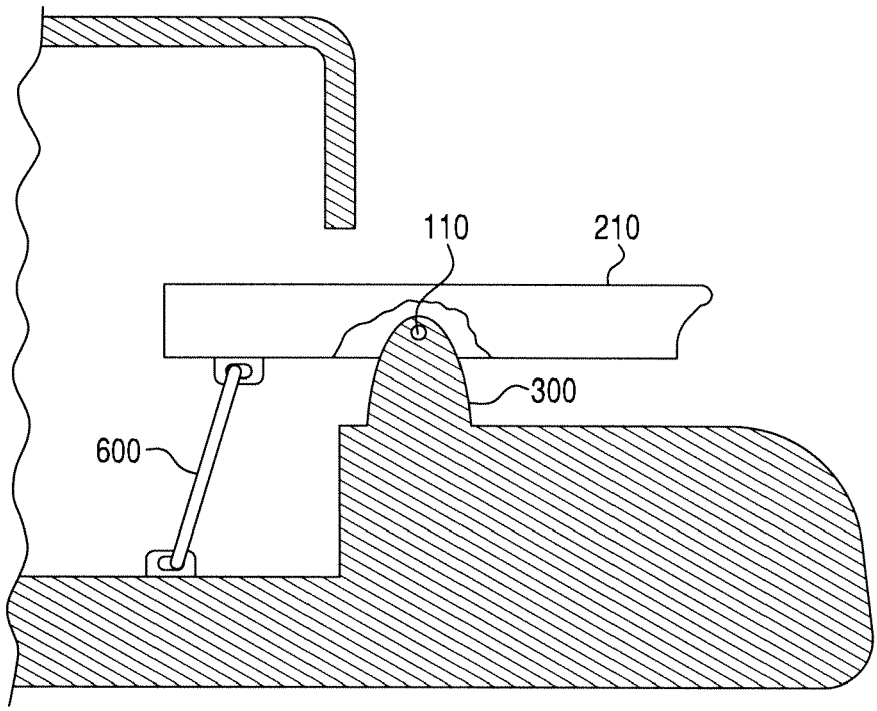
FIG. 8 schematically depicts another embodiment of the present invention.

Preferably the first key bias device 400 provides the return force due to its elasticity. For example, as shown in FIG. 2, a first key return spring 400 capable of delivering a constant force over a range of extensions may be utilized to practice at least some embodiments of the present invention. In another exemplary embodiment of the present invention, as shown in FIG. 8, an elastic component 600 capable of delivering such a constant force can also be utilized.

Referring back to FIG. 2, the preferred first key return spring 400 will be described. The first key return spring 400 can be structurally coupled to the first key 210 and the key support 300 by any appropriate means. As depicted in FIG. 2, the first key return spring 400 imparts a constant tensile force value onto the first key 210 throughout movement of the first key 210 between the rest position depicted in FIG. 2 and the depressed position depicted in FIG. 3.

The first return spring 400 applies a return force because it has been extended from its at-rest position to connect the first return spring 400 to the first key 210, and thus imparts a tension force on the extended portion of the spring retract the spring to its at-rest position. That is, the first return spring 400 applies a downward tensile force onto the key 210, and, owing to the relative attachment location of the first return spring 400 vis-à-vis pivot point 110, imparts a counter-clockwise moment onto the key 210 with respect to the view presented in FIG. 2. In other embodiments of the invention, the first return spring 400 may be applied on the other side of the pivot point 110. In such other embodiments, the first return spring 400 may be attached on the upper surface of the key 210 instead of the lower surface of the key 210 to obtain the counter-clockwise moment.

Figure 4:
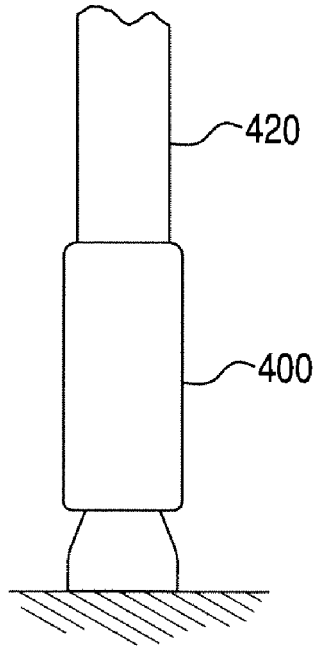
FIG. 4 schematically represents an end-view of the key return spring depicted in FIG. 2.
Figure 5:
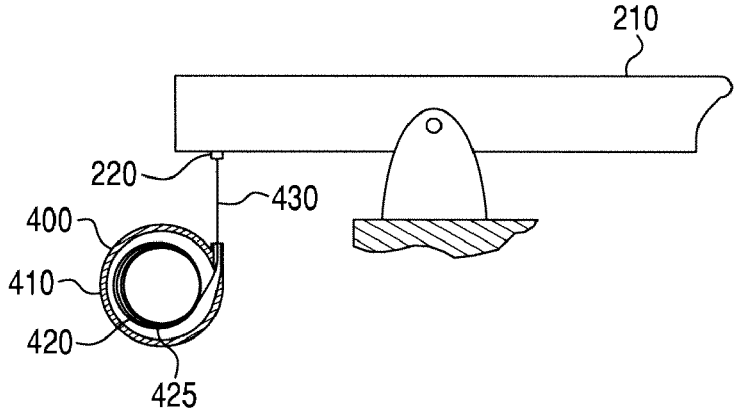
FIG. 5 schematically represents an interior view of the key return spring depicted in FIG. 2.

In an exemplary embodiment of the invention utilizing a constant force spring, the constant force spring is a prestressed, coiled strip of substantially flat spring stock, as may be seen by comparing FIG. 4, which shows an end view of the first key return spring 400, with FIG. 5, which shows a cross-sectional side view of the first key return spring 400. As may be seen in these figures, the prestressed coil strip of substantially flat spring stock 420 is coiled inside a spring housing 410 and extends through the spring housing 410 substantially linearly, with respect to section 430, to attach to a first spring connection location 220 on the first key 210.

An exemplary constant force spring that may be utilized in at least some embodiments of the present invention may be obtained from the Ametek Corporation, such as one of the springs of Ametek's Hunter Spring Products line. By way of example, the NEG'ATOR® Constant Force Extension Spring may be utilized as a first key return spring 400. In other embodiments of the present invention, other types of constant force springs may be utilized.

Figure 9:
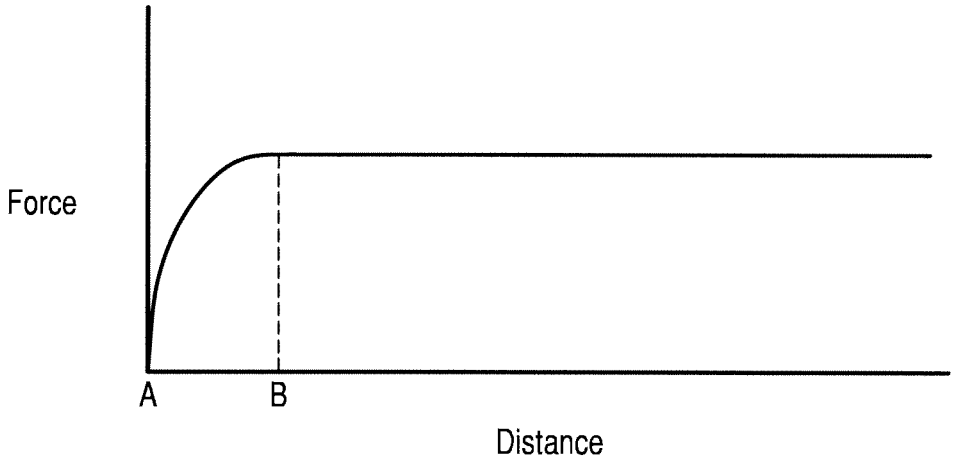
FIG. 9 presents a force-to-distance graph of a spring utilized in an embodiment of the present invention.

In some exemplary embodiments of the present invention, a portion 430 of the constant force spring 400 extends outward from the coiled portion 420 at least about one and one half times the outer coil 425 diameter before being mechanically linked to the first key 210 at linking location 220 when the first key 210 is in the rest position, as may be seen in FIG. 5. This is done so as to extend the spring a sufficient distance so that the spring exhibits a constant force after being extended this distance. In this regard, referring to FIG. 9, a graph is presented showing how force changes with spring extension distance in an exemplary constant force spring utilized in an embodiment of the invention. As may be seen, with respect to spring extension, there is a distance between point A, corresponding to a fully retracted/relaxed spring, and point B, corresponding to an extension length of a spring (which may vary from spring to spring), where the constant force spring 400 exhibits increasing force as the extension distance increases. However, after point B (the initial extension), the spring exhibits a constant force as the extension distance increases. By extending the spring one and one half times the outer coil 425 diameter, the spring is extended to/past point B, and thus further extension of the spring results in a constant force exerted by the spring even though the spring is extended an additional increment.

Some embodiments of the present invention are configured such that the magnitude of the moment applied by the first key return spring 400 onto the first key 210 may be changed without adjusting/changing the design of the first key return spring 400.

Figure 6:
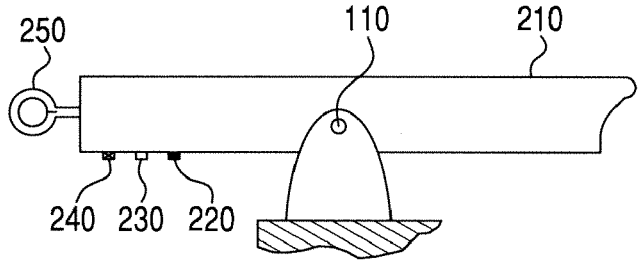
FIG. 6 schematically represents a key including multiple attachment locations according to an embodiment of the present invention.

By way of example only and not by way of limitation, attaching the first key return spring 400, which applies a constant tension force value to the first key 210, at different distances from the pivot point 110, various rotational moment magnitudes applied by the first key return spring 400 onto the first key 210 may be achieved, because the moment will increase with increasing distance from the first pivot point 110, even though the tension force value generated by the return spring 400 remains constant. Referring to FIG. 6, an embodiment of the invention includes multiple connection locations, such as, by way of example, locations 220, 230, 240, and 250, each being located at different distances from the pivot point 110 of the first key 210. By way of example, connection location 220 may be located 1 inch from pivot point 110, connection location 230 may be located 1.25 inches from pivot point 110, connection location 240 may be located one and one half inches from pivot point 110, and connection location 250 may be located two inches from the first pivot point 110. Embodiments of the present invention may be practiced with a fewer number or greater number of connection locations. Indeed, in some embodiments of the present invention, a single connector may be configured such that it may be slidably (able to move in a sliding manner) or otherwise adjustably connected (e.g., with a jack screw, etc.) to the first key 210 such that the distance from the pivot point 110 to the connection location may be essentially endlessly varied within a range of distances away from the pivot point 110, and once a desired distance from the pivot is achieved, the connection location may be "locked" into place. Alternatively, in other embodiments, an adhesive may be utilized to attach the spring 400 to any connection location at a desired distance from the first key.

Figure 7:
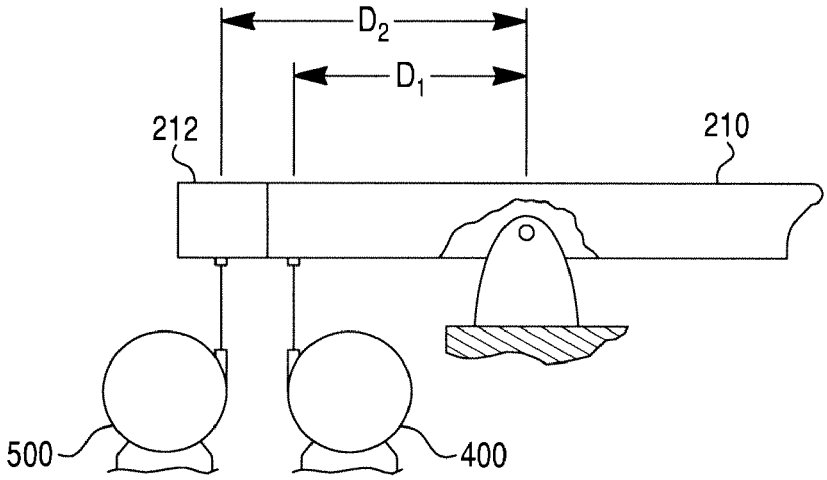
FIG. 7 schematically represents a side-view of a plurality of keys and their associated key return springs.

In view of FIG. 1, it will be seen that multiple keys are present in the electronic keyboard 100. Referring to the discussion above, in some embodiments of the invention, the rotational moments imparted onto a first key by a first constant force spring may be different than those imparted onto a second key by a second constant force spring of the same design as the first constant force spring, based on where the springs are attached to the keys with respect to the pivot points of the keys. Accordingly, in FIG. 7, there is depicted a second key 212 that is moveable between a rest position and a depressed position (not shown) in a manner concomitant to that of the first key 210, as discussed above. A second key return spring 500 is attached to the second key 212. The second key return spring 500 is configured to apply a return force to the second key 212 to bias the key towards the rest position, as shown in FIG. 7. In some embodiments of the present invention, the first key return spring 400, which is attached to the first key 210 as previously described, and the second key return spring 500, which is attached to the second key 220, apply substantially the same constant force value to the first key and the second key, respectively. (In some embodiments, this configuration is utilized so that the user feels an apparent force that is the same for a white key(s) and a black key(s), which are often different lengths.) However, as is shown in FIG. 7, because the attachment locations are different with respect to the pivot points of the keys (the pivot point of second key 212 being immediately behind that of first key 210, with reference to the view depicted in FIG. 7), the first key return spring 400 will impart a first rotational moment onto the first key that is less than the rotational moment imparted onto the second key 212 by the second key return spring 500, because the second key return spring 500 is connected to the second key 212 a distance $D_2$ from the pivot point of key 212, this distance $D_2$ being greater than a distance $D_1$ constituting the distance between the pivot point of the key 210 and the attachment location of the of the first key return spring 400 to key 210. In some embodiments of the present invention, the first key return spring 400 and the second key return spring 500 have identical configurations/are of the same design (i.e., they exert the same constant force value). Of course, in other embodiments of the present invention, constant force springs that exert different constant force values may be utilized to vary the moments applied to the keys (e.g., a black key may have a weaker/stronger return spring than a white key, etc.).

Embodiments of the present invention include both devices for implementing the present invention, and methods for implementing the present invention.

Given the disclosure of the present invention, one versed in the art would appreciate that there are other embodiments and modifications within the scope and spirit of the present invention. It is intended that the present invention cover all modifications and variations of the invention provided they come within the scope of the applied claims and their equivalents.

What is claimed is:

1. An electronic keyboard, comprising:

a plurality of keys including at least a first key and a second key;

a first key support supporting the first key for movement between a rest position and a depressed position, and a second key support supporting the second key through movement between a rest position and a depressed position;

a first key return spring including a constant force spring, configured to apply a return force to the first key to bias the first key toward the rest position of the first key, wherein the first key return spring is configured such that the return force has a substantially constant magnitude throughout the movement of the first key between the rest position and the depressed position of the first key; and a second key return spring configured to apply a return force to the second key to bias the second key toward the rest position of the second key, wherein the second key return spring is configured such that the return force of the second key return spring has a substantially constant magnitude throughout the movement of the second key between the rest position and the depressed position of the second key;

wherein the first key return spring and the second key return spring are configured to apply substantially the same constant force to the first key and the second key, respectively.

2. The electronic keyboard of claim 1, wherein the first key return spring includes a constant force spring comprising a prestressed, coiled strip of substantially flat spring stock.

3. The electronic keyboard of claim 2, wherein the constant force spring has an outer coil diameter, wherein a portion of the constant force spring extends outward a distance that is at least approximately one and one half times the outer coil diameter before being mechanically linked to the first key, when the first key is in the rest position.

4. The electronic keyboard of claim 1, wherein the first key return spring is configured to maintain the magnitude of the return force within a range of 1 ounce to five ounces, as measured at a fixed point on the first key, throughout the movement of the first key between the rest position and the depressed position.

5. The electronic keyboard of claim 1, wherein the first key return spring is configured to maintain the magnitude of the return force of the first key return spring within a plus or minus 20% deviation, as measured at a fixed point on the first key, throughout the movement of the first key between the rest position and the depressed position.

6. The electronic keyboard of claim 1, wherein the first key return spring extends between and is mechanically linked to the first key and the first key support, and wherein the first key return spring is in tension throughout the movement of the first key between the rest position and the depressed position.

7. The electronic keyboard of claim 1, wherein the first key has a plurality of connection locations at which the first key return spring can be connected to the first key, wherein each of the plurality of connection locations is located at a different distance from a first pivot point of the first key, and wherein the first key return spring imparts a different rotational moment onto the first key at each of the connection locations.

8. The electronic keyboard of claim 1, wherein the first key return spring is configured to impart a first rotational moment onto the first key, wherein the second key return spring is configured to impart a second rotational moment onto the second key that is greater than the first rotational moment.

9. The electronic keyboard of claim 8, wherein the first key return spring and the second key return spring have substantially identical configurations.

10. The electronic keyboard of claim 8, wherein the first key return spring is connected to the first key at a first distance from a first pivot point of the first key, wherein the second key return spring is connected to the second key at a second distance from a second pivot point of the second key, and wherein the second distance is greater than the first distance.

11. An electronic keyboard, comprising:

a plurality of keys including at least a first key and a second key;

a first key support supporting the first key for movement between a rest position and a depressed position, and a second key support supporting the second key for movement between a rest position and a depressed position;

a first key bias device including a constant force spring, configured to apply a return force to the first key to bias the first key toward the rest position of the first key, wherein the first key bias device is configured such that the return force has a substantially constant magnitude throughout the movement of the first key between the rest position and the depressed position of the first key, and wherein the return force results from elasticity of at least a portion of the first key bias device; and a second key bias device configured to apply a return force to the second key to bias the first key toward the rest position, wherein the second key bias device is configured such that the return force of the second key bias device has a substantially constant magnitude throughout the movement of the second key between the rest position and the depressed position of the second key, and wherein the return force of the second key bias device results from elasticity of at least a portion of the second key bias device;

wherein the first key bias device and the second key bias device are configured to apply substantially the same constant force to the first key and the second key, respectively.

12. The electronic keyboard of claim 11, wherein the first key bias device is configured to maintain the magnitude of the return force within a range of 1 to five ounces, as measured at a fixed point on the first key, throughout the movement of the first key between the rest position and the depressed position.

13. The electronic keyboard of claim 11, wherein the first key bias device is configured to maintain the magnitude of the return force within a plus or minus 20% deviation, as measured at a fixed point on the first key, throughout the movement of the first key between the rest position and the depressed position.

14. The electronic keyboard of claim 11, wherein the first key has a plurality of connection locations at which the first key bias device can be connected to the first key, wherein each of the plurality of connection locations is located at a different distance from a first pivot point of the first key, and wherein the first key bias device imparts a different rotational moment onto the first key at each of the connection locations.

* * * * *